United States Patent [19]

Tamary

[11] Patent Number: 4,755,848

[45] Date of Patent: Jul. 5, 1988

[54] SKIVE WITH ANTI-GOUGE STIFFENER

[75] Inventor: Ernest J. Tamary, Rochester, N.Y.

[73] Assignee: Eastman Kodak Company, Rochester, N.Y.

[21] Appl. No.: 94,215

[22] Filed: Sep. 8, 1987

[51] Int. Cl.[4] ..... G03G 15/00; G03G 15/20

[52] U.S. Cl. ..... 355/3 FU; 355/3 SH; 271/311

[58] Field of Search ..... 355/3 FU, 3 SH, 14 SH; 271/DIG. 2, 311; 219/216

[56] References Cited

U.S. PATENT DOCUMENTS

| | | | |
|---|---|---|---|
| 3,885,786 | 5/1975 | Schmalzbauer | 271/174 |
| 3,938,950 | 2/1976 | Weiler et al. | 271/80 |
| 3,992,000 | 11/1976 | Martin | 271/174 |
| 4,060,320 | 11/1977 | Doi et al. | 271/DIG. 2 X |
| 4,065,120 | 12/1977 | Imalzumi et al. | 271/174 |
| 4,336,992 | 6/1982 | Szlucha et al. | 355/3 FU |
| 4,378,152 | 3/1983 | Edwards et al. | 355/3 FU |
| 4,387,981 | 6/1983 | Cormier | 355/3 SH |
| 4,411,511 | 10/1983 | Ariyama et al. | 355/3 SH X |
| 4,447,054 | 5/1984 | Sone | 271/311 |

*Primary Examiner*—A. C. Prescott

*Attorney, Agent, or Firm*—G. Herman Childress

[57] ABSTRACT

A skive is used for removing a copy sheet from a hot fuser roller in electrographic apparatus, such as a copier/duplicator, or the like. The skive has a finger that engages the fuser roller at a small acute angle so that a sheet striking the finger is deflected from the roller. An anti-gouge stiffener adjacent the finger has a slot which receives the finger. A sheet deflected from the roller by the finger is guided by the finger into engagement with a portion of the stiffener spaced from the end thereof to avoid stubbing of the sheet on the end of the stiffener. The finger and stiffener are connected by a base and can be snapped onto a supporting bar.

4 Claims, 1 Drawing Sheet

SKIVE WITH ANTI-GOUGE STIFFENER

BACKGROUND OF THE INVENTION

The present invention relates to improvements in skives used, for example, for stripping a copy sheet from a hot fuser roller in electrographic apparatus.

Skives comprising elongate fingers have been used for stripping sheet-like members from rollers in apparatus of various types. More specifically, skives have been used for deflecting copy sheets from hot fuser rollers in electrographic apparatus. The fuser rollers in such apparatus commonly have a soft, flexible outer surface that is flexed as the copy sheet passes through the nip between a fuser roller and a back-up roller or between two such fuser rollers. This soft suface can be damaged by the skive fingers. Damage to the fuser roller can occur, for example, if the sheet leaving the nip between the rollers causes the skive finger to deflect in a direction which urges the tip end of the skive finger into the soft surface of the fuser roller, thereby gouging the roller surface.

Various attempts have been made to avoid the problem of a skive gouging a soft fuser roll. For example, in U.S. Pat. No. 4,336,992, issued on June 29, 1982 in the names of Szlucha et al, skive fingers are provided which are sufficiently flexible so that they can be deflected entirely out of contact with the fuser roller. The fingers can rotate 360 degrees and return to their operating position.

In other known skiving apparatus weights or springs are used to urge the tip end of the skive or sheet stripper into engagement with a rotating roller. Apparatus of this type is disclosed in U.S. Pat. Nos. 3,885,786 and 3,992,000.

The gouging problem results in expensive repair or replacement of the fuser roller and the skive itself. In addition, some prior skives are complex in construction and thus expensive to manufacture. Also, some known skives require accurate adjustment of weights, springs or other elements during assembly, or in order to maintain the required relationship between the skive and fuser roller. Accordingly, there is a need for an improved skive which will not gouge a fuser roller, and which is inexpensive, easy to install and simple to replace.

A skive with an anti-gouge stiffener is disclosed in my copending U.S. patent application Ser. No. 947,074, filed Dec. 29, 1986. That skive comprises a flexible finger and an anti-gouge stiffener that project from a base. The skive is supported from a bar so that the finger is flexed and has its end spaced from the base in contact with a roller for stripping a sheet from the roller. The anti-gouge stiffener has an end in contact with an intermediate portion of the finger to stiffen the finger and allow it to flex upwardly, but prevent it from flexing in the opposite direction and gouging the roller. A sheet deflected from the roller is guided by the stiffener along a sheet path. However, a sheet stripped from the roller by the finger can strike the end of the stiffener adjacent the finger, or a recess in the stiffener where the skive is mounted on the bar. This stubbing of the sheet can damage the sheet and interfere with its smooth movement along its path away from the roller. Accordingly, it is desirable to remove potential stubpoints from a skive such as disclosed in my copending application.

SUMMARY OF THE INVENTION

It is an object of the present invention to provide an improved skive that avoids gouging of fuser rollers. Another object of the invention is to provide an improved skive that is inexpensive, easy to install and replace, and will not buckle in a direction which causes damage to the fuser roller. A further object of the invention is to provide a skive as generally disclosed in my copending application which is free of stubpoints along the anti-gouge stiffener.

The present invention relates to an improved skive for deflecting a sheet-like member from a roller or the like wherein the skive has a flexible finger and an anti-gouge stiffener. The finger is longer than the stiffener and has an end portion engageable with the roller. Means are provided for supporting the stiffener and finger with the one end portion of the finger in contact with the roller for deflecting a sheet from the roller and with one end portion of the stiffener positioned adjacent the roller and the finger so that a sheet deflected by the finger is guided by the finger and stiffener along a sheet path leading away from the roller. In accordance with the invention, the one end portion of the stiffener has an elongate slot open at the end adjacent the roller. The end portion of the finger extends through the slot when in contact with the roller so that a sheet deflected from the roller by the finger can be guided by the finger into contact with a portion of the stiffener spaced from the end thereof nearest the roller to avoid stubbing of the sheet on the end of the stiffener. The portions of the stiffener defining the slot limit movement of the finger relative to the stiffener in the plane of the stiffener but without limiting movement of the finger relative to the stiffener in other directions.

The invention and its objects and advantages will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE DRAWINGS

Figure 1:
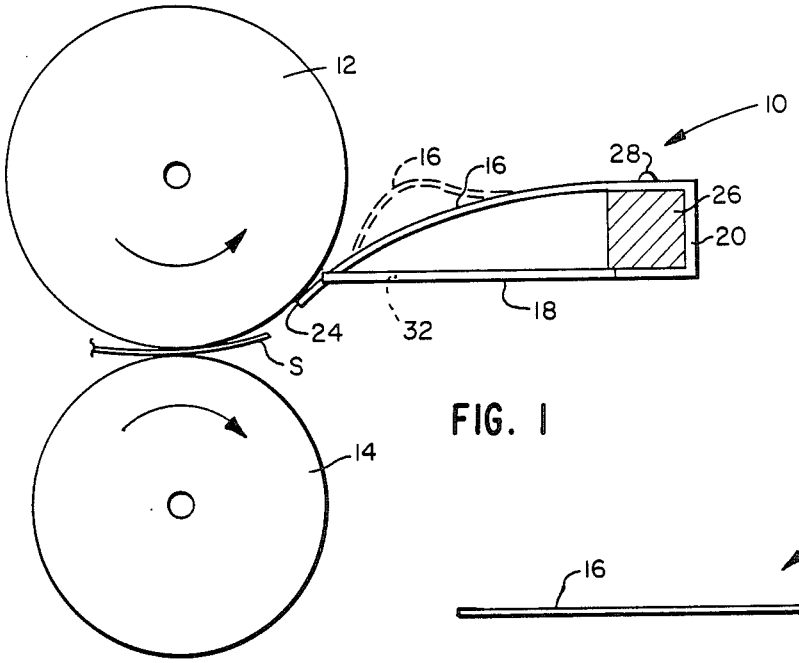
FIG. 1 is an enlarged fragmentary end view of a skive of the present invention shown mounted on a supporting bar in a position to strip a copy sheet from a fuser roller in an electrographic apparatus.
Figure 2:
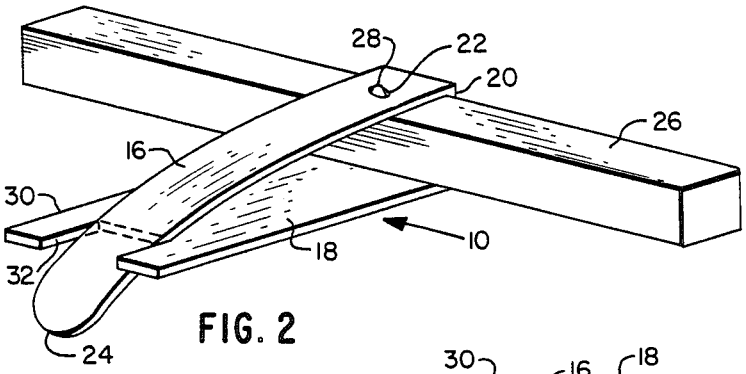
FIG. 2 is a perspective view of the FIG. 1 skive and supporting bar with the skive finger in the flexed position it occupies when in contact with a roller, but with the roller removed to better illustrate the skive.

Referring now to the drawings, a skive of the present invention is generally designated 10 and is illustrated in FIGS. 1 and 2 in a flexed condition for stripping a copy sheet S (FIG. 1) from a hot fuser roller 12 of an electrographic apparatus. The fuser roller fuses a toned image on the surface of the sheet by heating toner particles on the sheet. The sheet S passes between roller 12 and a second roller 14 which may comprise a hard metal roller that is urged against fuser roller 12 with sufficient force to deflect the soft outer surface of the fuser roller.

Alternatively, roller 14 can also be a fuser roller having a soft, flexible outer surface so that rollers 12 and 14 simultaneously can fuse images on opposite faces of the sheet S. The rollers are rotated in the direction illustrated in FIG. 1 by a drive mechanism, not shown.

Figure 3:
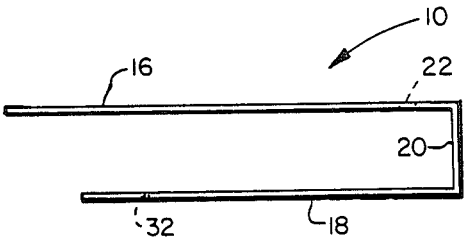
FIG. 3 is a view of the skive per se prior to being mounted in an electrographic apparatus.
Figure 4:
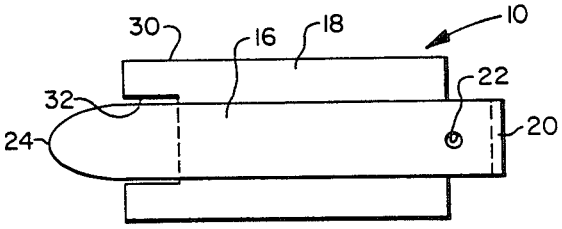
FIG. 4 is a plan view of the unmounted skive show in FIG. 3.

Skive 10 is manufactured in a generally U-shaped configuration, as shown in FIG. 3, and includes a flexible finger 16, an anti-gouge stiffener 18 and a base 20. Finger 16 is longer than stiffener 18 and is generally parallel thereto when the skive is not flexed in engagement with a fusing roller or the like. One end of the finger and stiffener are connected to opposite ends of the base 20 so that the finger and stiffener are spaced from each other. Finger 16 has a circular opening 22 adjacent the base 20 to facilitate mounting of the skive onto a support as explained later. As best shown in FIGS. 2 and 4, the end of finger 16 opposite from base 20 has a rounded, generally semi-circular configuration designated 24. This shape minimizes sharp edges or corners that might tend to gouge the fuser roller 12.

A bar 26 of generally rectangular cross-section is provided in the electrographic apparatus for supporting one or more of the skives relative to the fuser roller. The upper surface of bar 26 has one or more generally cylindrical projections 26. Only one such projection is illustrated in the drawings, but it will be understood that one projection is provided for each skive to be mounted on the bar. The diameter of projection 28 is slightly smaller than the diameter of opening 22 in finger 16 of the skive, and the outer end of the projection preferably is spherical in shape.

As best illustrated in FIGS. 2 and 4, stiffener 18 is wider than finger 18 from approximately the left edge of bar 26 to the left end portion 30 of the stiffener. A rectangular slot 32 formed in end portion 30 opens to the left end of the stiffener. The slot is slightly wider than finger 16, and the end portion of the finger is received in the slot when the finger is in contact with roller 12.

When the finger projects through the slot, the edges of the slot limit movement of the finger relative to the stiffener in the plane of the stiffener. However, the finger can move in other directions relative to the stiffener. Thus the finger can flex upwardly as shown in the dotted lines in FIG. 1 in response to a force applied to the end portion 26 of the finger when it is in the flexed position. Such a force might be received from a sheet adhering to roller 12, or from contact between the roller and finger. When the finger flexes into the position shown in dotted lines in FIG. 1, the finger does not gouge the roller, and the finger cannot flex in the opposite direction, where it could gouge the roller, due to the finger being captured in the slot 32 of the stiffener.

Stiffener 18 is spaced from the roller 12 and thus does not gouge the roller. The stiffener can be about 0.06 inch from the roller, for example.

During assembly of the skive 10 onto the bar 26, the skive is initially aligned with the bar so that finger 16 will extend along the top surface of the bar and the stiffener 18 will extend along the lower surface of the bar. The skive is then moved from right to left as viewed in FIG. 1 with the operator pressing against the skive base 20 to slide the skive onto the bar. Projection 28 will force finger 16 to flex upwardly until the opening 22 is aligned with projection 28. Then the finger snaps down and the projection 28 is captured in the opening to thereby latch the skive into position on the bar. The interface between the projection 28 and opening 22 also locates the skive at the desired position along the length of the bar. When mounted on the bar, base 20 of the skive is adjacent the side of the bar shown at the right in FIG. 1.

As the skive is moved into position on the bar the end 24 of the finger 16 first engages the curved surface of the fusing roll 16 and then is deflected downwardly from its normal position parallel to the stiffener 18 into its deflected or mounted position illustrated in FIG. 1 wherein the end 24 of the finger projects through slot 32 and is located beneath the stiffener 18. The inner end of slot 32 in stiffener 18 then engages or is closely adjacent an intermediate portion of the finger 16 to stiffen the relatively long finger 16 and yet permit it to flex upwardly as may be necessary in response to forces encountered during rotation of the fuser roll 12 and engagement of sheets S with the end 24 of the finger 16. Stiffener 18 prevents flexing of the finger in the opposite direction as explained previously. When the skive is mounted on the bar the end portion of the finger opposite from base 12 is located and held in a position where it defines a small acute angle with the roller 12.

When the skive is in its mounted position and a sheet S is fed into the nip between rollers 12 and 14, the sheet may tend to adhere to the heated roller 12. If it does, the leading end of the sheet engages the curved end 24 of the finger 16 of the skive and is deflected from the roller. The sheet then travels along a sheet path defined by the end portion 24 of the finger and the stiffener 18. Because the finger projects through slot 32, the finger guides the sheet to an intermediate part of the stiffener, instead of the left end thereof, thus avoiding possible stubbing of the sheet on the left end of the stiffener 18 of the skive. Also, the bottom of the stiffener is flat and smooth so it is free of possible stubpoints for a sheet. The stiffener and finger 16 thus provide a stub-free path for a sheet exiting from between the nip of the rollers.

If the sheet is especially difficult to separate from the roller 12, finger 16 may be deflected upwardly by the sheet a slight distance from its normal bowed condition, as indicated in dotted lines in FIG. 1. Flexing in the direction indicated is not harmful to the skive, sheet or to the surface of the fuser roller. This flexing will increase the pressure exerted by the finger against both the sheet and the fuser roller. However, the end portion 24 of the finger is in a position relative to roller 12 so that it defines a very small acute angle with a tangent to the roller and thus flexing to the dotted line position does not urge the end of the finger into a position where it will gouge the soft outer surface of roller 12. There will be some increase in pressure exerted by the finger due to the flexing and this will further facilitate stripping of the sheet S from the surface of the roller.

The flexing action described above thus can be tolerated, and it is unlikely it will damage the sheet or the fuser roller. On the other hand, if finger 16 flexed downwardly, or in the direction opposite to the direction shown, then the end 24 of the finger could reach a position where it was urged more directly into the surface of roller 12 and could gouge the roller and damage it, possibly making replacement of the roller necessary. Stiffener 18 prevents flexure of the finger 16 by a sheet on roller 12 in a downwardly direction i.e., in the direction opposite to that shown in dotted lines in FIG. 1. This is due, in part, to the fact that the slot 32 of the stiffener 18 captures finger 16 and prevents flexing of the finger downwardly. In other words, the stiffener holds an intermediate portion of the flexible finger 16 in a way which prevents it from flexing downwardly.

Once the finger begins flexing upwardly as illustrated by the dotted line position in FIG. 1, there are no forces acting on the finger which would tend to flex it downwardly again. Thus gouging of the roller is prevented by the skive 10.

As explained above, the skive is easily mounted on the bar 12 by simply snapping it into position with the projection 28 and opening 22 holding the skive in position relative to the fuser roller 12. Moreover, the projection 28 and opening 22 also prevent lateral movement of the skive along the bar. The skive can be easily removed from the apparatus by lifting the finger upwardly and moving the skive to the right as viewed in FIG. 1.

The skive can be made of metal, plastics or other suitable materials. If made of metal and skive preferably is formed from a single sheet or strip and bent into the shape illustrated. Then the skive can be heat treated. A spring steel material is suitable for use in forming the skive. If formed from plastics the skive can be molded into the shape illustrated in the drawings.

The invention has been described in detail with particular reference to a preferred embodiment thereof, but it will be understood that variations and modifications can be effected within the spirit and scope of the invention as described hereinabove and as defined in the appended claims.

I claim:

1. In a skive for deflecting a sheet-like member from a roller or the like, the skive having a flexible finger and an anti-gouge stiffener, the finger being longer than the stiffener and having an end portion engageable with the roller, and means for supporting the stiffener and finger with the one end portion of the finger sin contact with the roller for deflecting a sheet from the roller and with one end portion of the stiffener positioned adjacent the roller and the finger so that a sheet deflected by the finger is guided by the finger and stiffener along a sheet path leading away from the roller, the improvement comprising:

the one end portion of the stiffener having portions defining an elongate slot open at the end adjacent the roller, the one end portion of the finger extending through the slot when in contact with the roller so that a sheet deflected from the roller by the finger can be guided by the finger into contact with a portion of the stiffener spaced from the end thereof nearest the roller to avoid stubbing of the sheet on the end of the stiffener, the portions of the stiffener defining the slot limiting movement of the finger relative to the stiffener in the plane of the stiffener but without limiting movement of the finger relative to the stiffener in other directions.

2. The invention as set forth in claim 1 wherein the stiffener is wider than the finger, the supporting means comprises a bar having a projection thereon, and the skive finger having an opening therein which receives the projection on the bar to locate the skive on the bar, the opening being spaced from the one end portion of the finger that extends through the slot in the stiffener.

3. The invention as set forth in claim 1 wherein the surface of the stiffener guiding a deflected sheet along the sheet path is flat and smooth so that it is free of possible stubpoints for a sheet moving along the path.

4. In a skive for deflecting a sheet-like member from a roller or the like, the skive having a flexible finger and an anti-gouge stiffener, the finger being longer than the stiffener and having an end portion engageable with the roller, and means for supporting the stiffener and finger with the one end portion of the finger flexed into contact with the roller for deflecting a sheet from the roller and with one end portion of the stiffener positioned adjacent the roller and the finger so that a sheet deflected by the finger is guided by the finger and stiffener along a sheet path leading away from the roller and along one surface of the stiffener, the improvement comprising:

the one end portion of the stiffener being wider than the finger and having portions defining an elongate slot open at the end adjacent the roller, the one end portion of the finger extending through the slot and beneath the one surface of the stiffener when in contact with the roller so that a sheet deflected from the roller by the finger can be guided by the finger into contact with a portion of the stiffener spaced from the end thereof nearest the roller to avoid stubbing of the sheet on the end of the stiffener, the one surface of the stiffener being smooth and free of stubpoints for a sheet moving along the one surface, the portions of the stiffener defining the slot limiting movement of the finger in a direction that could cause the finger to gouge the roller.

* * * * *